US008365938B2

(12) United States Patent
Ohlson

(10) Patent No.: US 8,365,938 B2
(45) Date of Patent: Feb. 5, 2013

(54) GAS-TIGHT TRANSPORT CONTAINER FOR DETONATION-DANGEROUS MATERIAL

(75) Inventor: Johnny Ohlson, Kil (SE)

(73) Assignee: Dynasafe International AB, Stockholm (SE)

( * ) Notice: Subject to any disclaimer, the term of this patent is extended or adjusted under 35 U.S.C. 154(b) by 1155 days.

(21) Appl. No.: 11/575,023

(22) PCT Filed: Sep. 2, 2005

(86) PCT No.: PCT/SE2005/001267
§ 371 (c)(1),
(2), (4) Date: Aug. 19, 2008

(87) PCT Pub. No.: WO2006/041351
PCT Pub. Date: Apr. 20, 2006

(65) Prior Publication Data

US 2008/0314903 A1 Dec. 25, 2008

(30) Foreign Application Priority Data

Sep. 9, 2004 (SE) ..... 0402159

(51) Int. Cl.
*B65D 8/18* (2006.01)
*B65D 41/06* (2006.01)
*B65D 45/32* (2006.01)
*F17C 13/06* (2006.01)

(52) U.S. Cl. ..... 220/4.21; 220/582; 220/293; 220/319

(58) Field of Classification Search ..... 220/4.25, 220/4.24, 4.21, 584, 581, 900, 239, 298, 220/293, 319, 315, 200, 4.01, 582; 206/6; *B65D 45/32, 41/06, 41/04, 41/02, 8/18; F17C 13/06*
See application file for complete search history.

(56) References Cited

U.S. PATENT DOCUMENTS 1,144,683 A * 6/1915 Barder ..... 220/298
1,297,305 A * 3/1919 Thatcher ..... 220/560.02
(Continued)

FOREIGN PATENT DOCUMENTS

EP 33598 A2 * 8/1981
JP 1950/82 1/1982
(Continued)

OTHER PUBLICATIONS

English Translation of Office Action in corresponding application JP 2007-531112, mailed Nov. 12, 2010.

*Primary Examiner* — Mickey Yu
*Assistant Examiner* — Robert J Hicks
(74) *Attorney, Agent, or Firm* — Connolly Bove Lodge & Hutz LLP

(57) ABSTRACT

A gas-tight detonation-proof container for the transport and storage of detonation-dangerous material that can be opened and closed by remote control is provided. The container, which is of the type that can be opened by separation, will also, if required, be able to be used for the active detonation of dangerous material inside the same. The detonation-proof transport container according to the invention is particularly characterized in that it is opened and closed by a locking ring disposed between the two parts of the container and is arranged such that it can be circumrotated in the parting plane. In the closed state, the locking rings holds together the two parts of the container and, for this purpose, has a double-sided multi-toothed bayonet coupling which, upon a limited circumrotation, locks in the two parts of the container.

17 Claims, 3 Drawing Sheets

U.S. PATENT DOCUMENTS

| | | | | | |
|---|---|---|---|---|---|
| 2,841,308 | A | * | 7/1958 | Weicker | 220/293 |
| 2,936,093 | A | * | 5/1960 | Passalaqua | 220/298 |
| 3,107,810 | A | | 10/1963 | King | |
| 3,653,533 | A | * | 4/1972 | Mortensen | 220/298 |
| 3,655,090 | A | * | 4/1972 | Rothrock et al. | 220/298 |
| 3,804,288 | A | * | 4/1974 | Piegza | 220/320 |
| 3,886,047 | A | * | 5/1975 | Billups, Jr. | 435/305.3 |
| 3,990,605 | A | * | 11/1976 | Hanke et al. | 220/316 |
| 4,100,783 | A | | 7/1978 | Gambarov et al. | |
| 4,219,125 | A | * | 8/1980 | Wiltshire et al. | 220/4.13 |
| 4,466,551 | A | | 8/1984 | Leung | |
| 4,978,023 | A | * | 12/1990 | Behlmann et al. | 220/23.6 |
| 5,411,162 | A | * | 5/1995 | Koziczkowski et al. | 220/320 |

FOREIGN PATENT DOCUMENTS

| | | | |
|---|---|---|---|
| JP | 2000161491 | A | 6/2000 |
| SE | 462184 | | 5/1990 |

* cited by examiner

GAS-TIGHT TRANSPORT CONTAINER FOR DETONATION-DANGEROUS MATERIAL

CROSS-REFERENCE TO RELATED APPLICATIONS

This application is a National Stage of PCT/SE2005/001267 filed Sep. 2, 2005 which in turn claims priority from Swedish Application 0402159-8, filed Sep. 9, 2004 disclosure of which is incorporated herein by reference.

TECHNICAL FIELD

The present invention relates to a, in the closed state, gas-tight transport container of circular cross section and having an interior which can be made accessible by the fact that the two container parts obtained in the separation and demarcated one from the other are arranged so as to be openable one from the other by separation transversely to their own specific longitudinal direction, in which the two container parts, upon closure of the container, are locked one against the other by means of an intervening locking ring which is rotatable relative to the container parts transversely to their mutually facing end edges and which is locked in both container parts in one and the same locking operation by means of integral coupling elements.

The aforementioned invention can also be supplemented so that it also comprises a, in the closed state, gas-tight container, which is openable and closable by remote control, for the transport of detonation-dangerous material. The container in question should also, where necessary, be able to be used for the detonation of dangerous material inside the same. It should also withstand high detonation pressure and splintering which might have been caused in the detonation. Moreover, it should be designed such that the repair of the same, after an internal detonation therein bordering on its tolerance limit, is limited to an absolute minimum.

The term detonation-proof transport container has below been applied more or less generally. Of course, there is a limit to what a container of whatever type is capable of withstanding of internal detonations. In this case, therefore, we have considered the term to be relevant, since it precisely defines what we intended with the device according to the invention.

PROBLEM DEFINITION AND BACKGROUND TO THE INVENTION

Regardless of how an openable detonation-proof container of the aforementioned kind is designed, its weakest point, in the great majority of cases, will be constituted by its opening and the members which are used to keep the opening closed and gas-tight even after an internal detonation. At the same time, it is the sealing members of the opening function which, by necessity, must be made most complex and will therefore be most difficult to repair or replace.

Detonation-proof containers of the aforementioned kind are found in many different types and if they are really large they are generally provided with some kind of inward-opening door, which, in the closed state, seals against a pressure-absorbing door frame disposed outside the door. In the case of smaller detonation-proof chambers, it is very often impossible to use any inward-opening door or hatch, since this, in the open state and during the opening and closing operations, will block far too large a part of the inner capacity of the chamber. Smaller detonation-proof chambers must therefore often be made openable by separation.

PRIOR ART

In Swedish patent SE 9900624-9 there is described, for example, a transport container of this type for detonation-dangerous material, comprising a first substantially cylindrical container having a convex rear end face and an opening disposed in the other end of the cylinder, which opening covers the whole of the cross-sectional area thereof and is surrounded by a flange extending outwards from the opening and surrounding the same. The flange, in turn, forms part of the arrangement which is used to shut the chamber. In addition, the transport container according to the patent incorporates a second cap part of corresponding shape and cross-sectional measurement and provided with the same type of flange, which, however, when the container is to be closed, is turned in the opposite direction. In order to join together these two container parts, according to the invention an inner and an outer locking ring are used, which are held together by locking bolts. In the closed state, this detonation-proof chamber offers a wholly satisfactory protection for the environment and its closing function is easy to replace or repair in case of possible damage to the same caused by an internal, all too powerful detonation. However, the closing function in this design is constituted by a number of loose parts, which make it complicated to fit it in place with a remote-controlled manipulator, something which nowadays is often more or less a requirement.

OBJECT OF THE INVENTION AND ITS DISTINGUISHING FEATURES

An object of the present invention is to provide an improved, detonation-proof transport container for the storage and transport of detonation-dangerous or suspected detonation-dangerous material, which substantially eliminates the abovementioned problems.

The said object, and other aims which are not here enumerated, are satisfactorily met within the scope of that which is defined in the independent patent claim. Embodiments of the invention are defined in the dependent patent claims.

Thus, according to the present invention, an improved gas-tight transport container has been produced, which is characterized in that the transport container is detonation-proof for the storage and transport of detonation-dangerous or suspected detonation-dangerous material, in that, upon opening of the transport container, the two container parts are arranged so as to be axially displaceable one relative to each other, in that the locking ring has a multi-toothed double-sided bayonet coupling comprising two oppositely directed locking grooves with mutually facing coupling elements of the container parts disposed on either side thereof, whilst these container parts, in turn, have coupling elements matched to their respective bayonet coupling and each comprising a respective toothed rim, and in that the locking ring, upon closure of the transport container, can be rotated by a distance corresponding to at least one tooth width on the toothed rim to which the locking groove is matched.

According to further aspects of a detonation-proof transport container according to the invention, the following applies:

- that the coupling elements of the respective container part which are facing towards the locking ring are constituted by a considerable number of locking teeth, which are disposed along their own specific outer end edge facing, in the coupled-together state, towards the locking ring and extend radially outwards and inwards along the radially outer and inner peripheries respectively of the said end edge, whereby these locking teeth together form a double-sided toothed rim which closes off the transport container wall in the said direction and has a plurality of outward and inward facing locking teeth and, between these, radially directed tooth gaps, each matched to the periphery accessible to the respective toothed rim, and the said container parts which face one another with their open ends upon closure of the container being held together in the coupled-together closed state by the locking ring which is disposed rotatably relative to the said container parts between the end edges thereof and which, in turn, has the locking groove matched to each such end edge, each of which locking grooves having been matched to the end-closing double toothed rim of the respective container part and having therefore been configured with the same number of locking teeth disposed along their own specific inner and outer periphery, and the same number of tooth gaps as this, and a free space between their own specific locking teeth and the bottom of the respective locking groove, which bottom at least corresponds to the tooth thickness of the locking teeth in the one of the toothed rims of the container parts to which the locking groove in question is matched, that it comprises gas seals disposed between the outer end edge of the respective container part and the bottom of the respective locking groove, that the gas seal between the end edge of the respective container part and the bottom of the respective locking groove, on each container part, has been supplemented with a second gas seal between a peripheral collar projecting beyond the double toothed rim of the respective container part and the outer edge situated opposite the collar of the locking ring, that the respective gas seals are constituted by high-pressure hoses filled with inert gas.

ADVANTAGES AND EFFECTS OF THE INVENTION

The present invention now offers a transport container for detonation-dangerous or suspected detonation-dangerous material which is detonation-proof, is gas-tight in the closed state and can be opened by separation, and whose opening and closing function is suited to manipulation by remote control. Since the transport container according to the invention is opened by separation and the respective parts of the container are relatively heavy, it is expediently opened by its respective parts being mutually displaced in the axial direction along a rail system. For easier accessibility, moreover, one or both of the container parts, in their outer end position away from the other container part, may, if so desired, be made rotatable relative to the other container part and relative to the rail system.

The specific novelty with the transport container according to the invention is the manner in which its two parts are held together in the closed state. The two transport container parts are namely provided along their, in the closing position, mutually facing end edges with a considerable number of, along the outer and inner peripheries respectively of the said end edges, outward and inward facing locking teeth, which are combined to form a double toothed rim fixedly joined to the transport container wall. These respective toothed rims, which thus constitute the end edge of the respective transport container part, each therefore have a plurality of outward and inward facing locking teeth standing directly one in front of the other in the radial direction. Situated between the locking teeth in the respective toothed rim are tooth gaps arranged correspondingly one in front of the other in the radial direction. For geometric reasons, the number of locking teeth is equal to the number of tooth gaps. Since the, in the described manner, outward facing toothed rim automatically gains access to a larger periphery than the inward facing one, both tooth widths and tooth gap widths in the respective toothed rim are matched to the periphery accessible to the respective toothed rim.

In order to hold together the transport container parts in the brought-together closing position, according to the invention a specially configured locking ring is additionally used, which is rotatable relative to the container parts. This special locking ring thus has two oppositely directed locking grooves, each matched to the double-sided toothed rim of the respective transport container part, i.e. each locking groove has along its outer and its inner periphery the same number of locking teeth and tooth gaps as the double toothed rim to which it is matched. In addition, between the bottom of the respective locking groove and the locking teeth disposed along the peripheries of the locking groove there is a free space corresponding at least to the tooth width for the double toothed rim matched to the respective locking groove.

Locking teeth and tooth gaps in the locking ring and the double-sided toothed rims of the transport container parts are additionally coordinated so that the locking teeth in the toothed rim of the respective transport container, when the containers are pushed together into the closing position, are guided into matching tooth gaps in the locking grooves of the locking ring. As soon as the transport container parts have been fully pushed together, the locking ring is next rotated into the locked position, i.e. with the locking teeth in the locking ring wholly behind matching locking teeth in the respective toothed rim. For purely practical reasons, it is generally expedient to arrange for one of the parts of the transport container to be stationary and, upon opening of the container, to laterally displace the other one and likewise join the locking ring axially yet rotatably to the said fixed part. The other axially displaceable part of the container can, if so desired, be made rotatable so as to facilitate the supply or the removal of explosion-dangerous material. The supply and the removal of such material from the container can then be carried out using suitable manipulators. From the above-stated, it will be clearly apparent that all activities associated with the handling of the device according to the invention can be performed without difficulty by remote control behind safe protection. The device according to the invention thus meets all the requirements which might be placed upon devices of the aforementioned kind.

An additional advantage of the device according to the invention is, furthermore, that, since the toothed rims of the container parts are end-mounted, they are easy to replace in case of possible damage, whilst, at the same time, the rotatable locking ring is a loose part which can also therefore be easily replaced.

Further advantages and effects will emerge from study and consideration of the following detailed description of the invention, including one of its advantageous embodiments, the patent claims and the accompanying drawing figures.

DESCRIPTION OF THE FIGURES

The invention has been defined in the following patent claims and it will now be described only somewhat further in conjunction with the appended figures, in which:

DETAILED DESCRIPTION OF AN EMBODIMENT OF THE INVENTION

In the various figures, corresponding components have been given the same reference notations irrespective of the scales of the figures.

Figure 1:
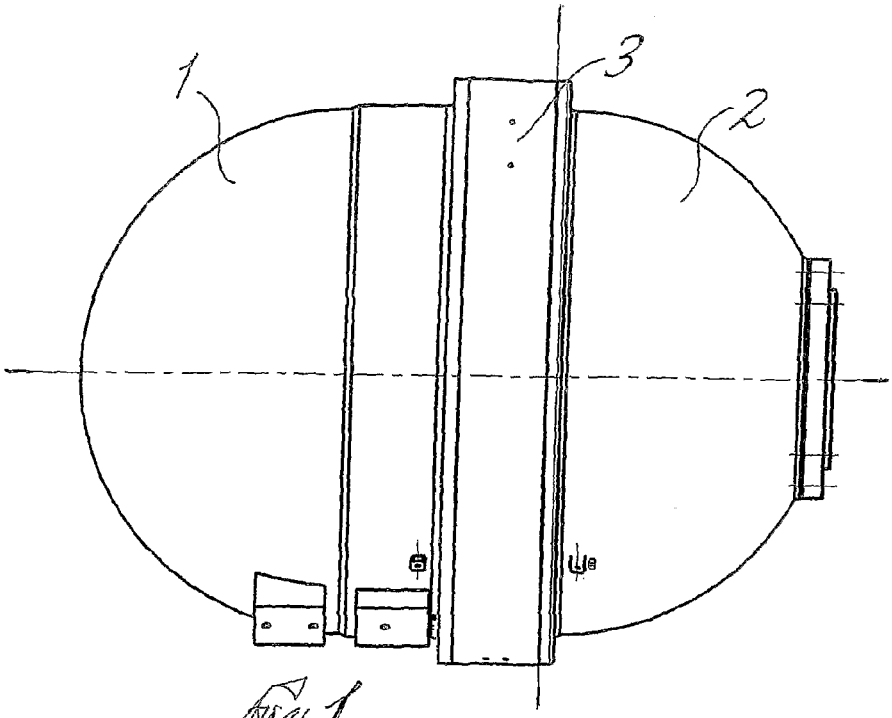
FIG. 1 shows a detonation-proof transport container in side projection.

The detonation-proof transport container according to FIG. 1 comprises a first and a second container part 1 and 2 and a locking ring 3 which holds together these container parts with the container in the closed state. The design of the actual container parts 1 and 2 has nothing to do with the invention and has therefore not been elaborated upon. As is evident, however, from FIG. 3 in particular, the dome-shaped chamber part 4 of the respective holder part is closed off with a row of inner and outer locking teeth 7 and 8 which is fixedly joined along the inner and outer periphery 5 and 6 of the said chamber part. Between the teeth in the respective row of teeth there are tooth gaps 9 and 10. The inner and outer locking teeth 7 and 8 form jointly with the intervening material a double-sided toothed rim, which expediently is given the same construction as the two parts 1 and 2 of the complete container. For holding together these two parts, with the container in the closed state, the locking ring 3 is used, the design of which can best be seen from FIGS. 4 and 5. This locking ring thus has two oppositely directed locking grooves 11 and 12, of which only the locking groove 11 is visible in FIG. 4, since the locking groove 12 is hidden in the figure. Each such locking groove 11 and 12 is matched to the double toothed rim on the container part with which it is meant to interact. The locking grooves 11, 12 each therefore have along their outer periphery 13 and their inner periphery 14 outer and inner locking teeth 15 and 16, which, with the container in the closed state, interact with the inner and outer teeth 7 and 8 in the double toothed rim which, with the container in the closed state, interacts with the locking groove in question and which closes off the container part 1 or 2 which is facing towards the locking grooves of the locking ring. In order to enable a locking between locking ring and toothed rim, between the teeth 15 and 16 of the locking ring and the bottom 17 of the locking groove there is a space 18 matched to the tooth thickness in the respective matching toothed rim. Upon closure of the container, the locking ring is therefore rotated by one tooth width so that the teeth 7, 8 of the toothed rims fall into their designated locking positions in the said space 18 behind, or more accurately, perhaps, inside the locking teeth 15, 16 of the locking ring 3.

Figure 2:
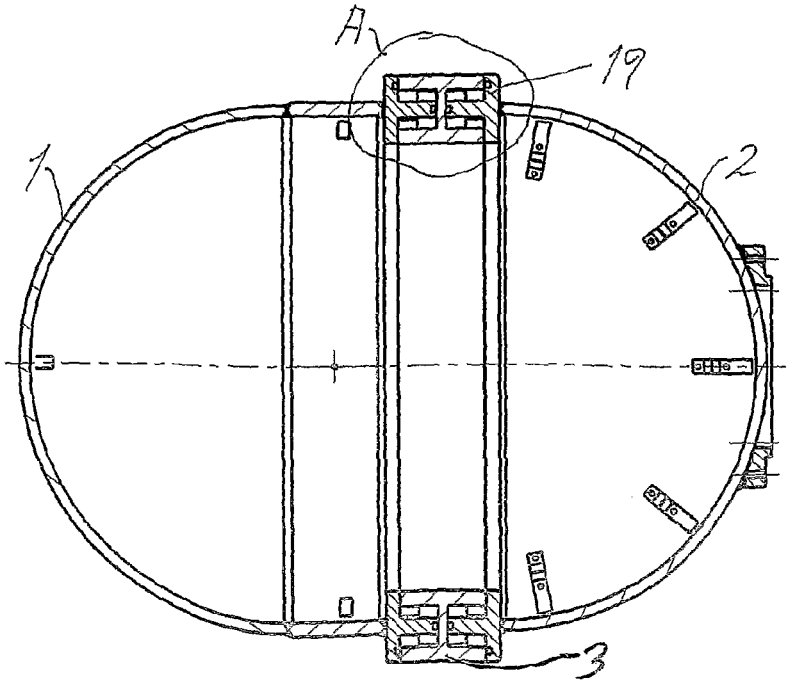
FIG. 2 shows a section through the transport container according to FIG. 1.
Figure 3:
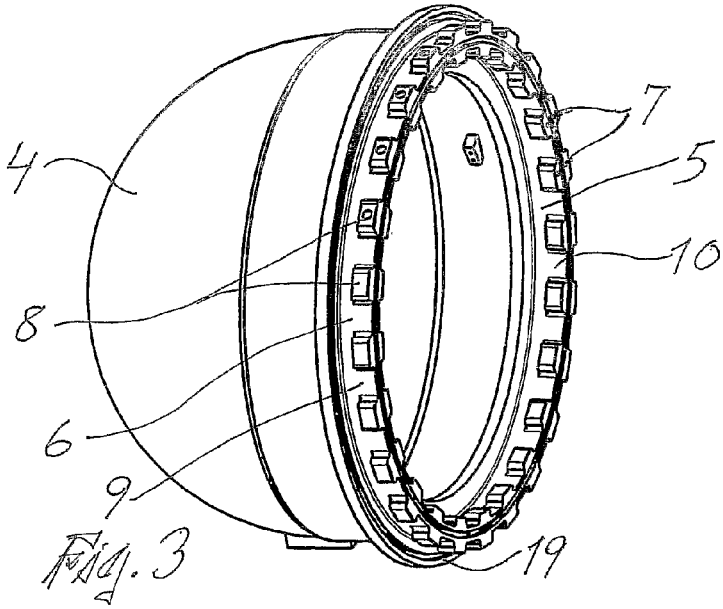
FIG. 3 shows an oblique projection of one of the container parts according to FIGS. 1 and 2.
Figure 4:
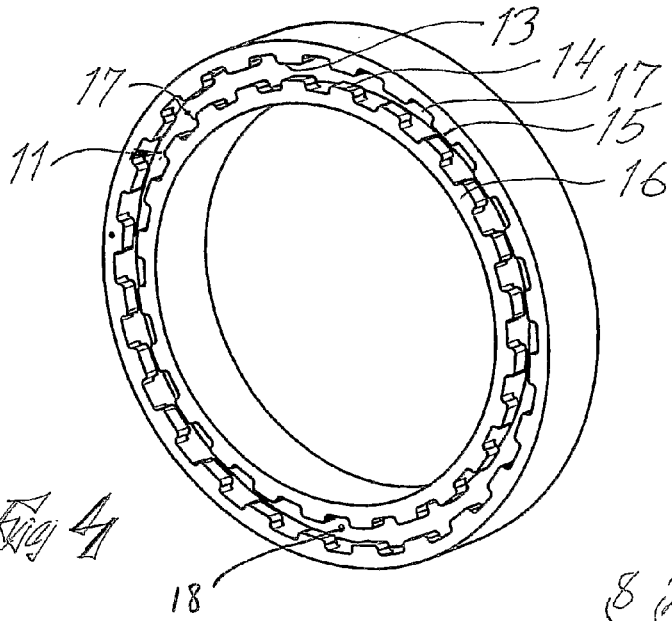
FIG. 4 shows an oblique projection of the locking ring belonging to the transport container.
Figure 5:
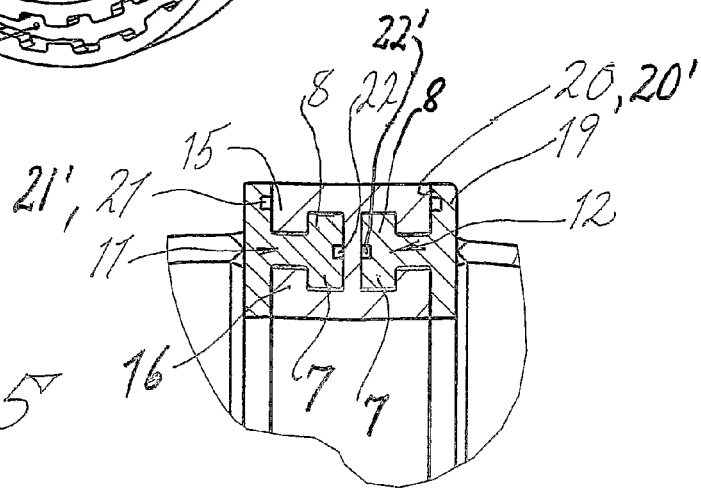
FIG. 5 shows an enlarged part-section A from FIG. 2.

As can further be seen from FIGS. 2, 3 and 5, each of the container parts 1 and 2 has an outer annular collar 19, in whose inner area 20, which, with the container in the closed state, faces towards the locking ring, an annular groove 21 has been made in which a high-pressure sealing hose for inert gas has been placed as a gas seal against the opposite outer edge 20' of the locking ring 3. The same type of groove 22 and high-pressure sealing hose is also disposed in respectively the outermost end edge of the double toothed rim of the respective container part, in which the groove in question has been made in the material between the teeth. This latter high-pressure sealing hose seals against the bottom 17 of the respective locking grooves 11, 12.

Figure 6:
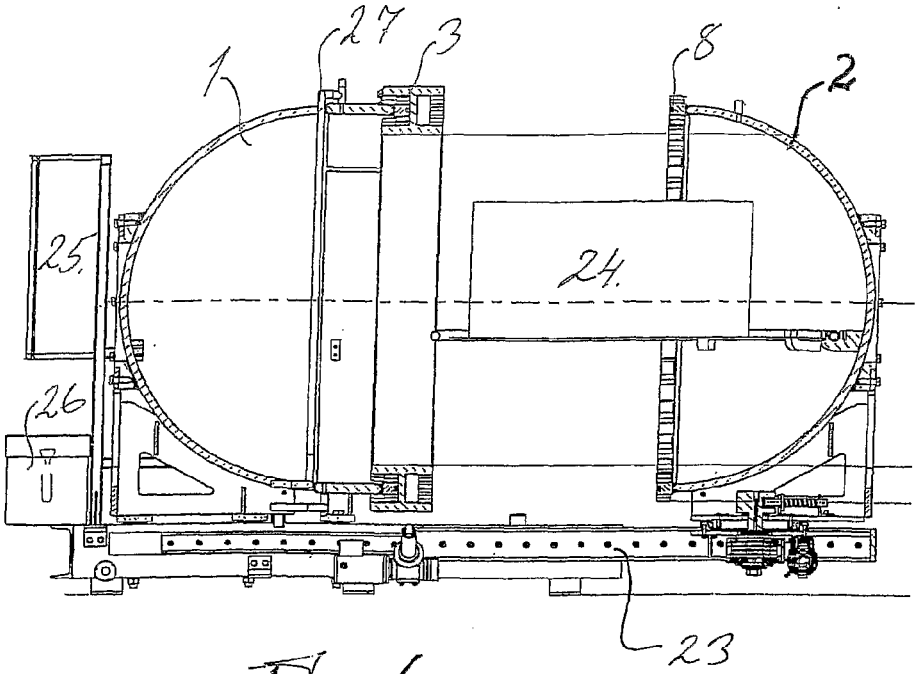
FIG. 6 shows a section through a complete device in the open state.
Figure 7:
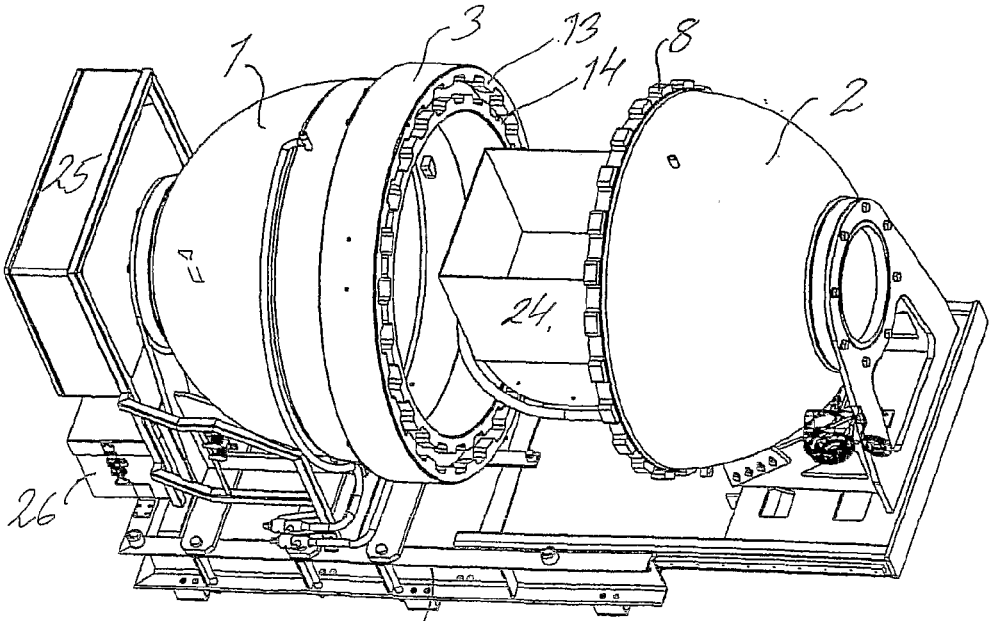
FIG. 7 shows an oblique projection of FIG. 6.

The more complete transport container according to the invention, shown in FIGS. 6 and 7, incorporates some extra components in addition to those already discussed, which latter, insofar as the scales of the figures tolerate this, have also been included in these figures. Included amongst these extra components, therefore, are a guide system 23 for pushing apart the two parts 1 and 2 of the container as it is opened, and an internal container 24 and a control cabinet 25, as well as space for own control batteries 26 and piping 27 for the supply of inert gas to the gas seals 21' and 22'. The circumrotation of the locking ring 3 can be easily arranged with a hydraulic piston, which in FIGS. 6 and 7, however, is hidden.

Alternative Embodiments

The invention is not limited to the illustrated embodiment but can be variously modified within the scope of the patent claims.

The invention claimed is:

1. A detonation-proof, in the closed state, gas-tight container of circular cross section, openable and having an interior which can be made accessible by the fact that two container parts obtained in the separation of the container are axially displaced from each other, in which both the parts, upon opening of the container, one from the other demarcated and relatively from each other displaceable container parts, upon closure of the container, are lockable one against the other by a locking ring, characterized in that the container is a transport container for the storage and transport of detonation-dangerous or suspected detonation-dangerous material, that the locking ring is arranged between the container parts, that the locking ring has a multi-toothed double-sided bayonet coupling with coupling elements mutually facing the container parts, whilst the two container parts, in turn, having coupling elements matched to their respective bayonet coupling, that the coupling elements of the respective container parts which are facing towards the locking ring are constituted by a plurality of locking teeth, which are disposed along an outer end edge of the respective container parts facing, in the coupled-together state, towards the locking ring and extend radially outwards and inwards along radially outer and inner peripheries respectively of said end edge, whereby said locking teeth together form a double-sided toothed rim which closes off a wall of the container and that the locking ring, in turn, has a locking groove matched to each such end edge, each of which locking grooves having been matched to the end-closing double toothed rim of the respective container part and that the locking ring is rotatably arranged relative to the container parts transversely to their mutually facing end edges and which locking ring is locked in both container parts in one and the same locking operation.

2. The detonation-proof transport container as claimed in claim 1, characterized in that the double-sided toothed rim having the plurality of outward and inward facing locking teeth and, between these, radially directed tooth gaps, each matched to the periphery accessible to the respective toothed rim, and the said container parts having open ends which face one another as the container is closed being held together in the coupled-together closed state by the locking ring which is disposed rotatably relative to the said container parts between the end edges thereof and which having been configured with a same number of locking teeth disposed along their own specific inner and outer periphery, and a free space between their own specific locking teeth and a bottom of the respective locking groove, which bottom at least corresponds to the tooth thickness of the locking teeth in the one of the toothed rims of a respective one of the container parts to which the locking groove in question is matched.

3. The detonation-proof transport container as claimed in claim 1, characterized in that the locking ring, upon closure of the transport container, can be rotated by a distance corresponding to at least one tooth width on the toothed rim to which the locking groove is matched.

4. The detonation-proof transport container as claimed in claim 1, further comprising a gas seal disposed between the outer end edge of the respective container part and the bottom of the respective locking groove.

5. The detonation-proof transport container as claimed in claim 4, characterized in that the gas seal between the end edge of the respective container part and the bottom of the respective locking groove, on each container part, has been supplemented with a second gas seal between a peripheral collar projecting beyond the double toothed rim of the respective container part and the outer edge situated opposite the collar.

6. The detonation-proof transport container as claimed in claim 5, characterized in that the respective gas seals are constituted by high-pressure hoses filled with inert gas.

7. The detonation-proof transport container as claimed in claim 2, characterized in that the locking ring, upon closure of the transport container, can be rotated by a distance corresponding to at least one tooth width on the toothed rim to which the locking groove is matched.

8. The detonation-proof transport container as claimed in claim 2 further comprising gas seals disposed between the outer end edge of the respective container part and the bottom of the respective locking groove.

9. The detonation-proof transport container as claimed in claim 3, characterized in that it comprises gas seals disposed between the outer end edge of the respective container part and the bottom of the respective locking groove.

10. A container having a longitudinal axis and an internal cavity for storing an object, comprising:

first and second shells, each having radially extending teeth about a circular portion of the first and second shells;

a circular locking ring having an inner flange, an outer flange, lateral sides and a wall;

the inner and outer flange defining a first recess on each side of the locking ring configured to mate with the radially extending teeth of the first and second shells; and the inner flange, the outer flange and the wall defining a second recess on each side of the locking ring configured to allow the locking ring to at least partially rotate relative to the first and second shells when the radially extending teeth are within the second recess;

wherein when the first and second shells and the locking ring are aligned along a longitudinal axis of the container and moved relative to each other to place the container in a closed position and unlocked state, the radially extending teeth pass through the first recess into the second recess; and wherein when the container is in the closed position the locking ring is configured to rotate about the longitudinal axis to misalign the radially extending teeth with the first recess such that the locking ring locks the container by preventing the first and second shells from separating along the longitudinal axis of the container;

wherein the radially extending teeth extend both radially inward and radially outward.

11. The container of claim 10, wherein the container is locked by rotation of the locking ring without rotation of the first and second shells.

12. The container of claim 10, further comprising a radial lip on the first and second shells configured to abut the locking ring when in the closed position.

13. The container of claim 12, further comprising a sealant along the lip of the first and second shells that abuts the locking ring to resist the flow of fluid into or out of the container when in the closed position.

14. The container of claim 10, further comprising a sealant along a lip of the radially extending teeth of the first and second shells that abuts the wall to resist the flow of fluid into or out of the container when in the closed position.

15. The container of claim 10, further comprising at least one of the first and second shells including a support structure for supporting an object with the cavity.

16. The container of claim 10, further comprising a first and second frames for moveably supporting the first and second shells, respectively, along the longitudinal axis of the container, wherein when the locking ring is mounted on either the first or second shell, at least one of the first and second frames moves to bring the first and second shells toward each other into the closed position of the container.

17. A container having a longitudinal axis and an internal cavity for storing an object, comprising:

first and second shells, each having inwardly and outwardly radially extending teeth about a circular portion of the first and second shells;

a circular locking ring having an inner flange, an outer flange, lateral sides and a wall;

the inner and outer flange defining a first recess on each side of the locking ring configured to mate with the radially extending teeth of the first and second shells; and the inner flange, the outer flange and the wall defining a second recess on each side of the locking ring configured to allow the locking ring to at least partially rotate relative to the first and second shells when the radially extending teeth are within the second recess;

wherein when the first and second shells and the locking ring are aligned along a longitudinal axis of the container and moved relative to each other to place the container in a closed position and unlocked state, the radially extending teeth pass through the first recess into the second recess; and wherein when the container is in the closed position the locking ring is configured to rotate about the longitudinal axis to misalign the radially extending teeth with the first recess such that the locking ring locks the container by preventing the first and second shells from separating along the longitudinal axis of the container.

* * * * *